United States Patent [19]

Warnier

[11] 4,249,687

[45] Feb. 10, 1981

[54] WEAPON CASING

[76] Inventor: Jean Warnier, 19, Rue Laborde, Bron 69500, France

[21] Appl. No.: 958,375

[22] Filed: Nov. 7, 1978

[30] Foreign Application Priority Data

Nov. 7, 1977 [FR] France ..... 77 34361

[51] Int. Cl.[3] ..... F41B 13/04

[52] U.S. Cl. ..... 224/913; 150/52 R

[58] Field of Search ..... 224/191, 202, 205, 206, 224/235, 250, 257, 913, 916, 917; 150/52 R, 52 G

[56] References Cited

U.S. PATENT DOCUMENTS

| | | | |
|---|---|---|---|
| 2,627,887 | 2/1953 | Becker | 150/52 R |
| 2,872,960 | 2/1959 | Kolpin | 150/52 R |
| 3,059,681 | 10/1962 | Lorbeski | 150/52 G |
| 3,316,951 | 5/1967 | Jacobson | 150/52 G |
| 3,336,961 | 8/1967 | Welsh | 150/52 R |

FOREIGN PATENT DOCUMENTS

| | | | |
|---|---|---|---|
| 1122826 | 8/1968 | United Kingdom | 150/52 D |

*Primary Examiner*—Stanley H. Tollberg
*Assistant Examiner*—Kenneth Noland
*Attorney, Agent, or Firm*—Sandler & Greenblum

[57] ABSTRACT

A housing or case for rifles or similar weapons which have integral carrying straps attached thereto is disclosed. The housing extends at least to the point where the lower strap section is attached to the weapon and is open to receive the weapon and is closed by a zipper. A lined sleeve adjacent the holster portion of the housing is integrally connected to the housing and is open at both ends in order to receive the upper strap section in a secure relationship. The housing can extend over the butt of the weapon and may include at least one additional side pocket therein.

4 Claims, 5 Drawing Figures

WEAPON CASING

BACKGROUND OF THE INVENTION

1. Field of the Invention

The object of the invention relates to a case of housing device used for rifles and carbines.

It is possible to use this flexible accessory for the protection of the weapon as well as for its transportation or in the course of use.

2. Discussion of the Prior Art

In the known devices of this type, one used either rigid cases for dismantled weapons, or cases or housings were one introduced the weapon ready for use with more or less difficulty.

It was necessary under all circumstances to have an exterior strap for transport and to remove this holster before reaching the hunting region, because this accessory was heavy and cumbersome.

SUMMARY OF THE INVENTION

The device according to the invention overcomes this inconvenience by providing a light, flexible enclosure having a reduced volume for covering the weapon and which utilizes the strap of the weapon for its transportation.

It is constituted by a closed holster encasing the barrel comprising at the height of the strap attachment on the weapon a sleeve whose zipper assures the sealing of the portion encasing the breech, the trigger guard and up to the height of the lower strap attachment.

BRIEF DESCRIPTION OF THE DRAWINGS

In the annexed drawings given by way of nonlimiting example of one of the embodiments of the object of the invention

DETAILED DESCRIPTION OF THE DRAWINGS

Figure 1:
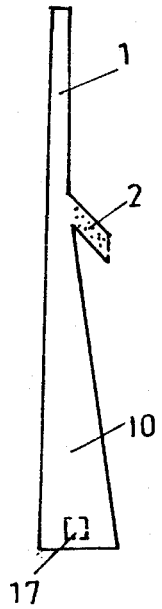
FIG. 1 shows the case viewed in elevation.
Figure 2:
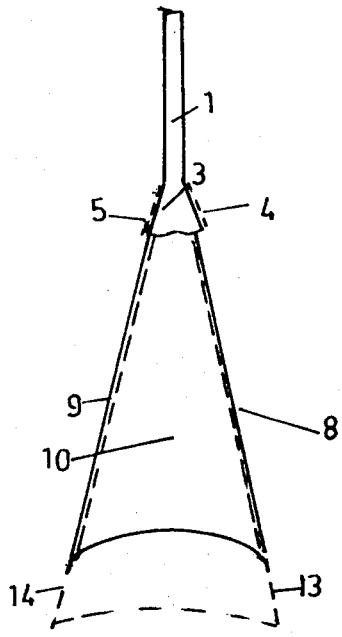
FIG. 2 shows the same object viewed from the front with the opening part developed.

The case or housing illustrated by FIG. 1 and 2 is constituted by an envelope of supple material, e.g. fabric, synthetic resin or leather, comprising a sealed upper portion forming closed holster 1.

Figure 4:
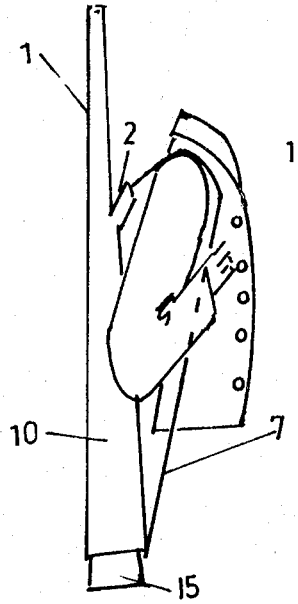
FIGS. 4 and 5 show the uses of the device.
Figure 5:
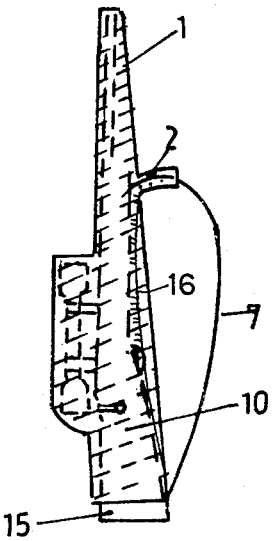

At the height of the upper strap attachment, the holster is open and with covering sleeve 2, forms a water tight, impermeable sleeve and surrounds the strap when the weapon is not carried on the shoulder. This sleeve is lined with a supple synthetic foam to assure the sealing of the joint when the weapon is transported (FIG. 4).

This sleeve is formed by an oblique open surface 3 provided at each of its edges 4, 5 by a hooked zipper strip to permit its joinder. It is lined with a synthetic foam which is supple to permit the passage of the strap and to block the spaces between the apex and the base.

One thus obtains a casing with a tubular projection 6 (FIG. 3) which the strap 7 passes and which freely clears and follows without any difficulty the movements of the carrier. The edges of the lower portion of the housing 9 form an envelope having a progressive diameter 10 and covers the butt stock 11 up to the height of the strap carrier 12. This lower envelope includes a zipper 16 connected to the sleeve zipper in order to insure immobilizing coverage of the weapon up to the height of the lower strap attachment.

This enveloping portion of the base may possibly descend lower, it being necessary for this purpose to latch the end and leave the flaps 13-14 free to reach the base of the butt stock. These extensions may be blocked off by any type of closure.

Figure 3:
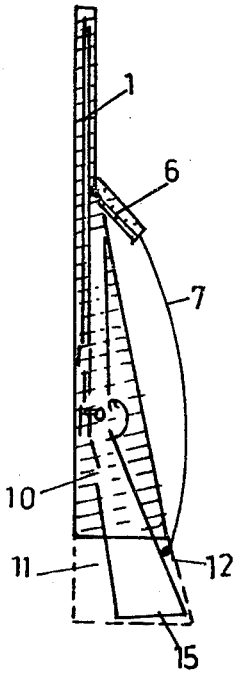
FIG. 3 is a view showing the weapon situated in the case.

However the most functional shape is shown in FIG. 3, in solid lines, which provides at the lower portion of the housing a pocket 17 to carry bandages or other objects.

During transport as illustrated by FIG. 3 or in case of nonuse, the weapon is recovered and the barrel and breech are under cover.

The sleeve 6 stabilizes the holster which cannot slide and maintains the housing assembly in place which is a desired safety feature.

At the hunting area in case of bad weather, the weapon remains covered. The zipper being open, one can immediately remove the weapon and use it.

On the way, it will be protected from dirt, twigs, and other objects able to jam the mechanisms.

Finally, one can, in view of the insignificant encumberment, place it in a pocket or sack in which animals are carried in order to always have this housing ready for use.

However, the shapes, dimensions and dispostions of the different elements may be varied within the limit of equivalents as well as the methods used for this fabrication, without changing the general conception of the invention which has just been described to do this.

What is claimed is:

1. A housing or case for a rifle or similar weapon having a carrying strap with two sections attached to said weapon to facilitate the transport thereof, said housing being comprised of a supple and water tight material which can be folded, said housing including an open lower end portion in the form of an envelope and an open sleeve extending outwardly from said housing, a lining for said sleeve, a sleeve zipper for closing and sealing said sleeve around said strap, one of said attached strap sections comprising a lower strap attachment section connected to said rifle, said open lower end portion extending to said lower strap attachment section and having a zipper connected to said sleeve zipper.

2. The housing or case in accordance with claim 1 in combination with said strap, said strap including an upper section securely held within said sleeve so that said strap will remain in position with respect to said housing.

3. A housing or case in accordance with claim 1 wherein said lining is formed of a synthetic foam material.

4. A housing or case in accordance with claim 1 further comprising at least one utility pocket in said lower end portion.

* * * * *

UNITED STATES PATENT AND TRADEMARK OFFICE

CERTIFICATE OF CORRECTION

PATENT NO. : 4,249,687

DATED : February 10, 1981

INVENTOR(S) : Jean WARNIER

It is certified that error appears in the above—identified patent and that said Letters Patent is hereby corrected as shown below:

Column 1, line 6, "of" should be --on--; and
line 14, "were" should be --where--.

Column 2, line 32, "dispostions" should be --dispositions--.

Column 2, line 52, "The" should be --A--.

Signed and Sealed this

Nineteenth Day of May 1981

[SEAL]

Attest:

RENE D. TEGTMEYER

Attesting Officer

Acting Commissioner of Patents and Trademarks